US006012301A

United States Patent [19]

Fujimoto et al.

[11] Patent Number: 6,012,301

[45] Date of Patent: Jan. 11, 2000

[54] THERMAL EXPANSION VALVE

[75] Inventors: Mitsuya Fujimoto; Kazuhiko Watanabe; Masamichi Yano, all of Tokyo, Japan

[73] Assignee: Fujikoki Corporation, Tokyo, Japan

[21] Appl. No.: 09/057,453

[22] Filed: Apr. 9, 1998

[30] Foreign Application Priority Data

Apr. 11, 1997 [JP] Japan ..... H9-093572

[51] Int. Cl.[7] ..... F25B 41/04

[52] U.S. Cl. ..... 62/225; 236/92 B

[58] Field of Search ..... 62/225; 236/92 B

[56] References Cited

U.S. PATENT DOCUMENTS

| | | | |
|---|---|---|---|
| 3,537,645 | 11/1970 | Treder | 236/92 B |
| 4,344,566 | 8/1982 | Götzenberger | 236/92 B |
| 5,303,864 | 4/1994 | Hirota | 62/225 |

FOREIGN PATENT DOCUMENTS

| | | |
|---|---|---|
| 0 356 642 A1 | 3/1990 | European Pat. Off. . |
| 0 691 517 A1 | 1/1996 | European Pat. Off. . |
| 0 836 061 A1 | 4/1998 | European Pat. Off. . |

*Primary Examiner*—William E. Tapolcai
*Attorney, Agent, or Firm*—Armstrong, Westerman, Hattori, McLeland, & Naughton

[57] ABSTRACT

A valve body of a thermal type expansion valve comprises of a fist path 32 and a second path 34 as the valve body 30, and a rod member 316 forming a heat sensing shaft **36*f* is a shaft having a small diameter, and according to the displacement of the diaphragm 361 of the power element member 36, the shaft is driven back and forth crossing the path 34. The rod member 316** has an overall length whose ratio is 17 to 28 against the outer diameter size, and is formed not to buckle against the stress added in the axial direction, which contributes to the miniaturization and lighter weight of the valve as a whole.

2 Claims, 2 Drawing Sheets

THERMAL EXPANSION VALVE

BACKGROUND OF THE INVENTION

The present invention relates to a thermal expansion valve used for refrigerating means utilized in refrigeration cycles of air conditioner, refrigeration device and the like.

In the prior art, these kinds of thermal expansion valves were used in refrigeration cycles of air conditioners in automobiles and the like. FIG. 2 shows a prior art thermal expansion valve in cross-section together with an explanatory view of the refrigerartion cycle. The thermal expansion valve 10 includes a valve body 30 formed of prismatic-shaped aluminum comprising a refrigerant duct 11 of the refrigeration cycle having a first path 32 and a second path 34, the one path placed above the other with a distance in between. The first path 32 is for a liquid-phase refrigerant passing from a refrigerant exit of a condenser 5 and through a receiver 6 to a refrigerant entrance of an evaporator. The second path 34 is for a gas-phase refrigerant passing through the refrigerant exit of the evaporator 8 towards a refrigerant entrance of a compressor 4.

An orifice 32*a* for the adiabatic expansion of the liquid-phase refrigerant supplied from the refrigerant exit of the receiver 6 is formed on the first path 32, and the first path 32 is connected to the entrance of the evaporator 8 through the orifice 32*a* and passing the path 321. The orifice 32*a* comprises a center line along the longitudinal direction of the valve body 30. A valve seat is formed on the entrance of the orifice 32*a*, and a valve means 32*b* supported by a valve member 32*c* and forming a valve structure with the valve seat exists on the valve seat. The valve means 32*b* and the valve member 32*c* are fixed together. The valve member 32*c* is forced by a spring means 32*d*, for example, a compression coil spring.

The first path 32 where the liquid-phase refrigerant from the receiver 6 is introduced is a path of the liquid refrigerant, and is equipped with an entrance port 322, and a valve chamber 35 connected thereto. The valve chamber 35 is a chamber with a floor portion, which is formed on the same axis as the center line of the orifice 32*a*, and is sealed by a plug 39.

Further, in order to supply driving force to the valve body 32*b* according to an exit temperature of the evaporator 8, the valve body 30 is equipped with a small hole 37 and a large hole 38 having a greater diameter than the hole 37 formed on the extended line of said center line axis perforating through the second path 34. A screw hole 361 for fixing a power element member 36 working as a heat sensor is formed on the upper end of the valve body 30.

The power element member 36 is comprised of a stainless steel diaphragm 36*a*, an upper cover 36*d* and a lower cover 36*h* each defining an upper pressure operation chamber 36*b* and a lower pressure operation chamber 36*c* formed so as to contact each other with said diaphragm in between, being divided by said diaphragm forming two sealed chambers above and under the diaphragm 36*a*, and a tube 36*i* for enclosing a predetermined refrigerant working as a diaphragm driver liquid into said upper pressure operation chamber, which is fixed to the valve body 30 through a screw 361. Said lower pressure operation chamber 36*c* is connected to said second path 34 through a pressure hole 36*e* formed concentric to the center line axis of the orifice 32*a*. A refrigerant vapor from the evaporator 8 is flown through the second path 34. The second path 34 is a path for the gas-phase refrigerant, and the pressure of said refrigerant vapor is loaded to said lower pressure operation chamber 36*c* through the pressure hole 36*e*.

Further, a heat sensing shaft 36*f* comprising a heat sensing portion 318 exposed inside the path 34 so as to cross said path 34 is formed to contact the diaphragm 36*a* inside the lower pressure operation chamber 36*c* and slidably positioned inside the large hole 38 penetrating the second path 34, which not only transmits the exit temperature of the refrigerant of the evaporator 8 to the lower pressure operation chamber 36, but also provides driving force by sliding inside said large hole 38 in response to the displacement of the diaphragm 36*a* accompanied by the difference in pressure inside the upper pressure operation chamber 36*b* and the lower pressure operation chamber 36*c*. An operation shaft 37*f* is positioned slidably inside the small hole 37 which presses the valve means 32*b* against the spring force of the spring means 32*d* in response to the displacement of the heat sensing shaft 36*f*. Said heat sensing shaft 36*f* having the diaphragm 36*a* contacting to its surface comprises of a stopper portion 312 having a large diameter working as a receiving portion of the diaphragm 36*a*, a large diameter portion 314 slidably inserted inside the lower pressure operation chamber 36*c* having one end surface contacting to the back surface of the stopper portion 312, and a heat sensing portion 318 having one end surface contacting to the other end surface of said large diameter portion, and the other end surface being connected to the operation shaft 37*f*.

The heat sensing shaft 36*f* is further equipped with a ring-shaped sealing member, for example, an O-ring 36*g*, so as to provide a sealed status between the first path 32 and the second path 34. The heat sensing shaft 36*f* and the operation shaft 37*f* are connected to each other, and the operation shaft 37*f* is in contact with the valve means 32*b*. Together, the heat sensing shaft 36*f* and the operation shaft 37*f* form a rod member which is the valve driving shaft.

In the structure of such thermal expansion valve, a known diaphragm driving liquid is filled inside the upper pressure activating chamber 36*b* of the upper cover 36*d*, and the heat of the refrigerant vapor from the refrigerant exit of the evaporator 8 flowing through the second path 34 is transmitted to the diaphragm driving liquid through the second path 34, the heat sensing portion 318 exposed to the pressure hole 36*e* connected to the second path 34, and the diaphragm 36*a*.

The diaphragm driving liquid inside the upper pressure operation chamber 36*b* loads pressure to the upper surface of the diaphragm 36*a* by turning into gas in correspondence to said heat transmitted thereto. The diaphragm 36*a* is displaced in the upper or lower direction according to the difference between the pressure of the diaphragm driving gas loaded to the upper surface thereto and the pressure loaded to the lower surface thereto.

The displacement of the center portion of the diaphragm 36*a* to the upper or lower direction is transmitted to the valve member 32*b* through the valve member driving shaft and moves the valve member 32*b* closer to or away from the valve seat of the orifice 32*a*. As a result, the flow rate of the refrigerant is controlled.

That is, since the temperature of the gas phase refrigerant on the exit side of the evaporator 8 is transmitted to the upper pressure operation chamber 36*b*, the pressure inside the upper pressure operation chamber 36*b* changes according to said temperature, and the exit temperature of the evaporator 8 rises. That is, when the heat load of the evaporator is increased, the pressure inside the upper pressure operation chamber 36*b* rises, and accordingly, the heat sensing shaft 36*f* or valve member driving shaft is moved to the downward direction and pushes down the valve means 32*b*, resulting in a wider opening of the orifice 32*a*. This increases the supply rate of the refrigerant to the evaporator 8, and lowers the temperature of the evaporator 8. In contrast, when the temperature of the evaporator 8 decreases and the heat load of the evaporator is lowered, the valve means 32*b* is driven in the opposite direction as the explanation above, resulting in a smaller opening of the orifice 32*a*. The supply rate of the refrigerant to the evaporator decreases, and the temperature of the evaporator 8 rises.

SUMMARY OF THE INVENTION

In the above-mentioned thermal expansion valve of the prior art, the heat sensing shaft 36*f* was of a member having a relatively large diameter, for example, approximately 6 mm, and this member together with the operation shaft 37*f* form the rod member, which drives the valve means.

However, in the prior art thermal expansion valve, in the attempt to reduce the number of members being used and to reduce the weight, when creating said rod member by forming the heat sensing shaft and the operation shaft as one unit, there is a need to consider the possibility of a buckling occurring to said rod member. When this buckling occurs to said rod member, a problem occurs to the driving movement of the valve means, and by this problem, the control of the flow rate by said expansion valve becomes unstable.

The present invention considers this problem, and aims at providing a thermal expansion valve which is capable of an accurate flow rate control, which prevents the buckling of the rod member having the heat sensing function.

In order to solve the problem, the thermal expansion valve of the present invention comprises a valve means having a first path where a refrigerant flowing toward an evaporator passes, and a second path where the gas-phase refrigerant flowing from the evaporator to the compressor passes, an orifice mounted in the first path, a valve means for controlling the amount of refrigerant passing through said orifice, a power element member mounted on the valve body having a diaphragm being displaced by sensing the temperature of said gas-phase refrigerant, and a rod member having a heat sensing function for driving said valve means according to the displacement of the diaphragm, characterized in that when the outer diameter size of the rod member is represented by d, and the overall length of the rod member is represented by L, the rod member is set so that the ratio of L/d is in the range of 17 to 28.

Further, the thermal expansion valve of the present invention includes said rod member comprised of a heat sensing shaft portion and an operation shaft portion having a smaller diameter than said heat sensing shaft portion, and when the outer diameter size of the rod member of said heat sensing shaft portion is represented by d, and the overall length of said rod member is represented by L, the ratio of L/d is set in the range between 17 to 28.

The thermal expansion valve of the present invention having the structure disclosed above is formed so that the rod member having a heat sensing function for driving the valve means is set to have a small diameter with no buckling occurring to said rod member, so the valve is able to control the flow rate accurately, even with a small diameter.

PREFERRED EMBODIMENT OF THE INVENTION

Figure 1:
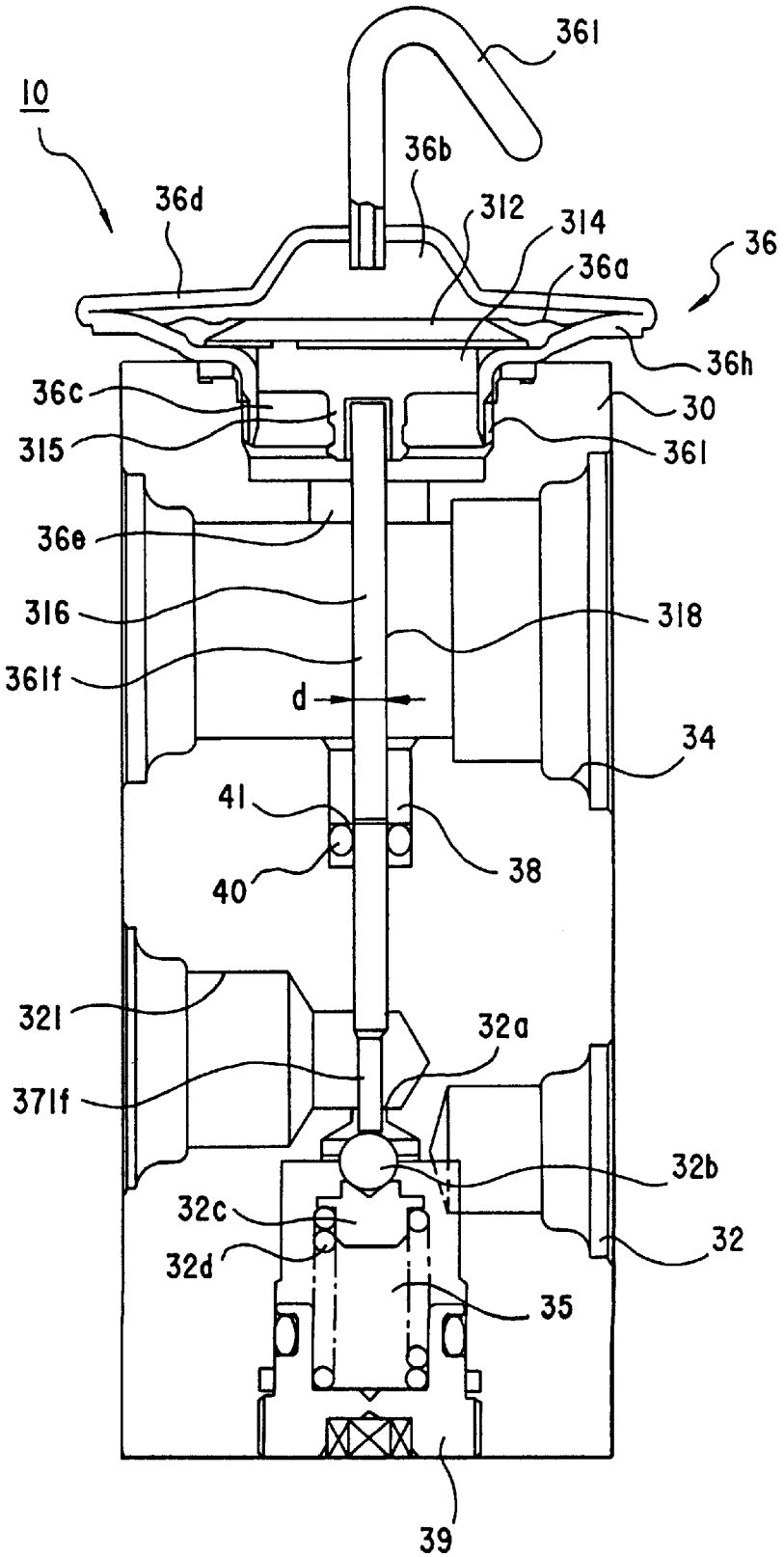
FIG. 1 is a vertical cross-sectional view showing one embodiment of the thermal expansion valve according to the present invention.
Figure 2:
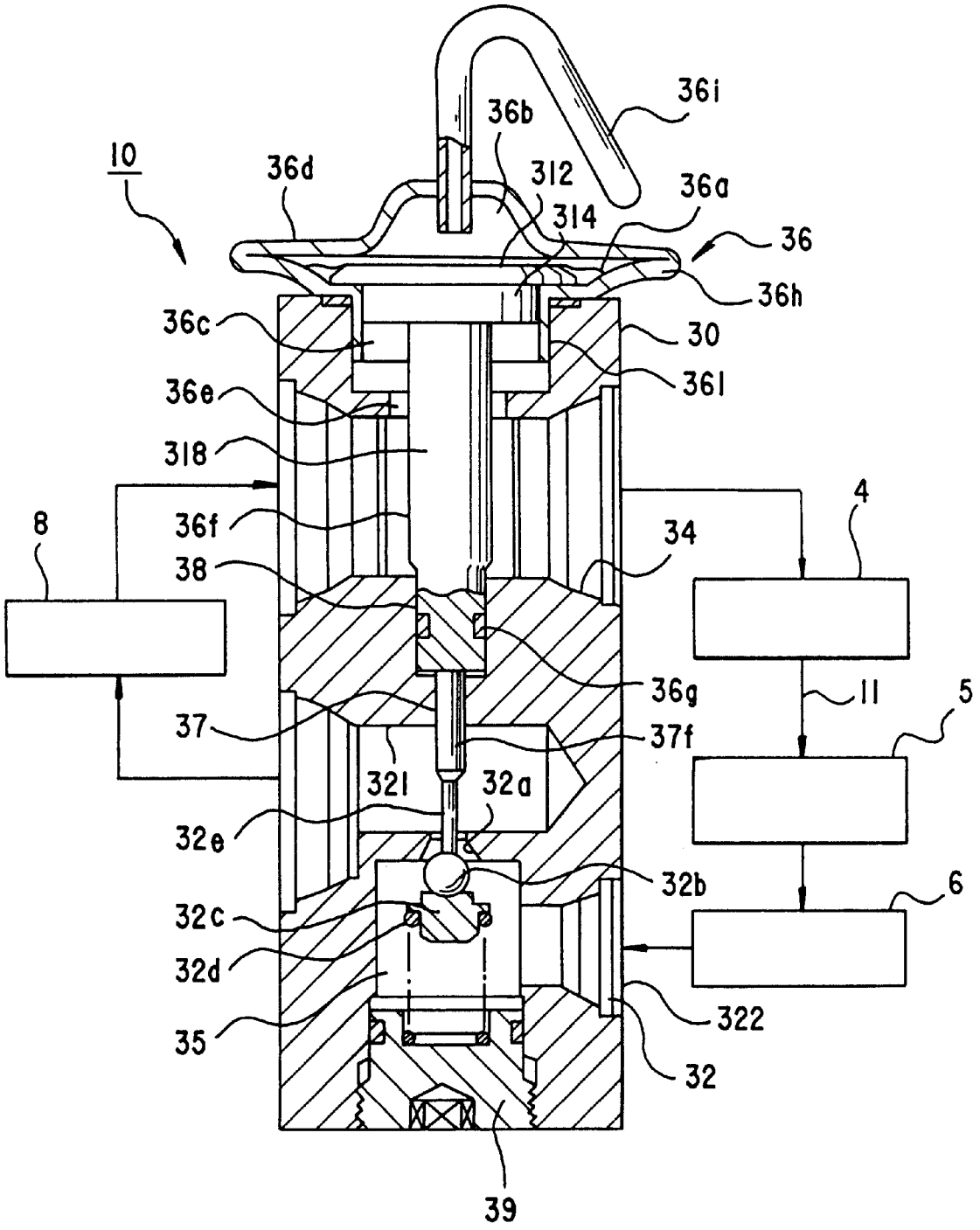
Fig.2 PRIOR ART
FIG. 2 is a vertical cross-sectional view showing the structure of the thermal expansion valve of the prior art.

FIG. 1 is a cross-sectional view showing one embodiment of the thermal expansion valve of the present invention omitting the refrigeration cycle, and the members having the same reference numbers as FIG. 2 show either the same or equal portions. However, the structure of the rodmember for driving the valve body differs from the expansion valve shown in FIG. 2.

In FIG. 1, the valve body 30 of the thermal expansion valve 10 comprises a first, path 32 and secondpath 34, and an orifice 32*a* is mounted in the first path 32. The orifice 32*a* is controlled of its opening status by a spherical valve means 32*b*. In between the first path 32 and the second path 34 is formed a hole 38 with large diameter, and a shaft-shaped rod member 316 having a small diameter inserted slidably in said hole 38 transmits the operation of the diaphragm to the valve means 32*b*.

The heat sensing portion 318 having a heat sensing function comprises of a heat sensing shaft 361*f*, a stopper portion 312 having a large diameter which works as a receiving unit of the diaphragm where said diaphragm 36*a* contacts the surface thereof, a large diameter portion 314 inserted slidably to the interior of the lower pressure operation chamber 36*c* having one end surface contacting the back surface of said stopper portion 312 and the center portion of the other end surface formed on a protrusion 315, and a rod member 316 having one end surface fitting to the interior of the protrusion 315 of said large diameter portion 314, and another end surface contacting and connected to said valve means 32*b* through a portion 371*f* corresponding to the operation shaft, and forming a unit structure. The heat sensing shaft 361*f* forming the rod member 316 is exposed inside the second path, where the heat from the refrigerant is transmitted.

Further, in the present embodiment, the valve body 30 utilizes the prior a-t expansion valve body, and the rod member 316 which is the heat sensing shaft 361*f* could be driven back and forth freely intersecting the path 34 according to the displacement of the diaphragm 36*a* of the power element member 36, which forms a clearance (gap) connecting the path 321 and the path 34 along the rod portion 316. In order to prevent this connection, an o-ring 40 is positioned inside the hole 38 with large diameter contacting the outer peripheral of the rod portion 316 so that an o-ring exists between the two paths, and a push nut 41 working as a self-locking nut is mounted to the rod portion 316 so as to be positioned inside the large diameter hoe 38 contacting to the o-ring 40 so that the o-ring 40 will not be moved by the received power operating towards the longitudinal direction (the direction where the power element member 36 exists) by the coil spring 32*d* and the refrigerant pressure of the path 321.

Now, the diameter size of the rod member 316 is set as d, and the overall length where the both end portions contact the large diameter portion 314 and the valve means 32*b* is set as L.

The load added to said rod member 316 in the axial direction is confirmed by experiment to be approximately 7.5 Kgf at most.

The main function that the rod member 316 must have is to transmit the operation of the diaphragm 36*a* of the power element to the valve means 32*b* accurately, to adjust the opening status of the orifice 32*a* accurately so as to control the flow rate of the liquid-phase refrigerant flowing through the first path 32, and to sense the temperature of the gas-phase refrigerant flowing through the second path 34 at the heat sensing portion 318, and transmit the same to the power element member 36 accurately.

In order to achieve a lighter weight, it is effective to set the diameter size of the heat sensing shaft 361*f* forming the rod member exposed at the second path 34 as small as possible, but when the diameter size is set too small, there is fear that buckling may occur to the rod member. When buckling happens, a loss occurs to the transmission power from the diaphragm 36*a* of the power element member, and accurate opening of the valve could no longer be achieved.

According to the refrigerating ability and the style of the piping of an air conditioning device in a car and the like where the expansion valve is connected, the diameter size of the first path 32 and the second path 34, and the distance between the two are limited. From these conditions, a stainless steel is used as the rod member 316, and the length L of said member is set to approximately 50 mm. The minimum diameter size of the rod member 316 having a 50 mm length size which will show no buckling even when it receives a 7.5 Kbf axial load could be calculated from a theory formula of the buckling.

From said theory formula, the minimum diameter size d of the rod member 316 being gained is;

d=1.65 mm.

If the safety factor is set to 1.4, the practical minimum diameter size could be set to 1.8 mm.

The maximum diameter size of the rod member 316 is limited by the projection area of the heat sensing portion 318 in the cross-sectional area of the second path 34.

When it is set to approximately 10% of the diameter size of the second path 34, the diameter size will be approximately 3 mm. Having such size, it will not provide a large resistance against the flow of gas-phase refrigerant passing the second path 34.

When expressing the above limited value by the ratio of length size and diameter size, the (length/diameter) will be in the range between 17 to 28.

The above-mentioned embodiment of the present invention shows the case where the rod member 316 comprises of a heat sensing shaft 361*f* portion and an operation shaft 371*f* having a smaller diameter, forming a path which secures an appropriate and maximum flow rate. The present invention is not limited to such case, but the member 316 could, of course, be formed by a heat sensing shaft 361*f* portion and an operation shaft 371*f* portion which are formed continuously and with the same diameter.

According to the thermal expansion valve of the present invention, the operation of the diaphragm of the power element is transmitted to the valve means, and the rod member controlling the flow rate of the liquid-phase refrigerant is formed to have a very small size, but also corresponds to buckling stress. Therefore, a thermal expansion valve which is miniaturized and with a lighter weight could be provided.

We claim:

1. A thermal expansion valve comprising a valve body having a first path where a liquid-phase refrigerant flowing toward an evaporator passes, and a second path where a gas-phase refrigerant flowing from the evaporator to a compressor passes; an orifice mounted on said first path; a valve means for controlling the amount of refrigerant passing through said orifice; a power element member mounted on said valve body and having a diaphragm being displaced by sensing the temperature of said gas-phase refrigerant; and a rod member having a heat sensing function for driving said valve means by the displacement of said diaphragm; characterized in that when the outer diameter size of the rod member is represented by d, and the overall length of the rod member is represented by L, the ratio of L/d is 17 to 28.

2. A thermal expansion valve comprising a valve body having a first path where a liquid-phase refrigerant flowing toward an evaporator passes, and a second path where a gas-phase refrigerant flowing from the evaporator to a compressor passes; an orifice mounted on said first path; a valve means for controlling the amount of refrigerant passing said orifice; a power element member mounted on said valve body and having a diaphragm being displaced by sensing the temperature of said gas-phase refrigerant; and a rod member having a heat sensing function for driving said valve means by the displacement of said diaphragm; wherein said rod member comprises a heat sensing shaft portion and an operation shaft portion which has a smaller diameter than said heat sensing shaft portion, said valve means being driven by said heat sensing shaft portion through said operation shaft portion, and when the outer diameter size of the rod member is represented by d, and the overall length of the rod member is represented by L, the ratio of L/d is 17 to 28.

* * * * *